US008947058B2

(12) United States Patent
Ozasa

(10) Patent No.: US 8,947,058 B2
(45) Date of Patent: Feb. 3, 2015

(54) SWITCHING POWER SUPPLY DEVICE, AC POWER SUPPLY DEVICE, AND IMAGE FORMING APPARATUS

(75) Inventor: Dan Ozasa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 448 days.

(21) Appl. No.: 13/362,418

(22) Filed: Jan. 31, 2012

(65) Prior Publication Data

US 2012/0212196 A1 Aug. 23, 2012

(30) Foreign Application Priority Data

Feb. 17, 2011 (JP) ..... 2011-032106
Sep. 13, 2011 (JP) ..... 2011-199532

(51) Int. Cl.
*G05F 1/59* (2006.01)
*G03G 15/00* (2006.01)

(52) U.S. Cl.
CPC ..... *G03G 15/80* (2013.01)
USPC ..... 323/271; 323/282

(58) Field of Classification Search
CPC ..... H02M 3/1588; G05F 1/595
USPC ..... 323/271, 282
See application file for complete search history.

(56) References Cited

U.S. PATENT DOCUMENTS 8,125,206 B2 * 2/2012 Akiyama et al. ..... 323/284
2008/0278125 A1 * 11/2008 Pigott ..... 323/271
2009/0015220 A1 * 1/2009 Nagasawa et al. ..... 323/271
2009/0224732 A1 * 9/2009 Kudo et al. ..... 323/271
2010/0277143 A1 * 11/2010 Kudo et al. ..... 323/271
2011/0127975 A1 * 6/2011 Hosokawa et al. ..... 323/271
2011/0163731 A1 * 7/2011 Qiu et al. ..... 323/271
2012/0212196 A1 * 8/2012 Ozasa ..... 323/271
2012/0217940 A1 * 8/2012 Kiadeh et al. ..... 323/271
2012/0217942 A1 * 8/2012 Kudo ..... 323/271
2013/0009619 A1 * 1/2013 Khanna et al. ..... 323/271
2013/0049719 A1 * 2/2013 Kudo et al. ..... 323/271
2014/0009130 A1 * 1/2014 Galbis et al. ..... 323/271

FOREIGN PATENT DOCUMENTS

JP 2003-284352 10/2003
JP 2010-263713 11/2010

* cited by examiner

*Primary Examiner* — Jeffrey Sterrett
(74) *Attorney, Agent, or Firm* — Oblon, Spivak, McClelland, Maier & Neustadt, L.L.P.

(57) ABSTRACT

A switching power supply device includes a switching power supply integrated circuit that includes a dead time generating unit that generates high-side and low-side drive signals having a dead time based on a PWM signal, a drive signal generating unit that generates first and second PWM signals based on the drive signals and a voltage of an output terminal, and a driver that includes high-side and low-side switch elements driven by the PWM signals; a filter that is connected to the output terminal; a first diode having a cathode connected to the source of the high-side switch element and an anode connected to the output terminal; and a second diode having a cathode connected to the source of the low-side switch element and an anode connected to the output terminal. The first and second diodes are arranged outside the switching power supply integrated circuit.

11 Claims, 12 Drawing Sheets

SWITCHING POWER SUPPLY DEVICE, AC POWER SUPPLY DEVICE, AND IMAGE FORMING APPARATUS

CROSS-REFERENCE TO RELATED APPLICATIONS

The present application claims priority to and incorporates by reference the entire contents of Japanese Patent Application No. 2011-032106 filed in Japan on Feb. 17, 2011 and Japanese Patent Application No. 2011-199532 filed in Japan on Sep. 13, 2011.

BACKGROUND OF THE INVENTION

1. Field of the Invention

The present invention relates to a switching power supply device and, more particularly, the present invention relates to a circuitry which improves heat dissipation efficiency for an integrated switching power supply.

2. Description of the Related Art

Accompanying an increasing global warming phenomenon, energy saving for reducing $CO_2$ which is the cause of the global warming phenomenon is a task in every scene. In the field of a power supply in particular, an energy-saving power supply is common knowledge. That is, a highly efficient converting method is very significant, and many highly efficient converting methods are used for a switching power supply. Also inside an image forming apparatus, a high efficiency is provided by replacing, for example, a charging high-voltage power supply with a switching power supply type. Further, replacement with a switching power supply increases the number of components and makes an arrangement of the components complicated, and therefore a power supply control system is also integrated. Particularly, similar to the charging high-voltage power supply, a power supply of comparatively low power consumption is known to employ a configuration where driver FETs are built in an integrated circuit.

FIG. 15 is a configuration diagram of a driver section and a filter when driver FETs are built in an integrated circuit in a conventional switching power supply. In FIG. 15, a PCHFET 112 and an NCHFET 111 which are the driver FETs are a high-side driver and a low-side driver, and are driven by pulse width modulation signals PWM_H and PWM_L, respectively. A PWMO is an output signal of the integrated circuit, and is connected to a coil 115 of the filter. The coil 115 and a capacitor 116 of the filter are arranged on a power supply board, and an output OUT of the filter is supplied to a load 113. Naturally, the cutoff frequency of the filter is set lower than frequencies of PWM signals. FIG. 2 illustrates voltage characteristics of an output OUT for a common PWM signal. An output voltage becomes high in proportion to the duty ratio (high period/(high period+low period)) of the PWM signal. Generally, part of the output voltage is fed back and is compared with a setting value to control the output voltage.

An operation of the switching power supply in FIG. 15 will be described with reference to FIGS. 16 to 18. Generally, in case where drive signals are shared with the high-side driver and the low-side driver, at an instant when the drive signal has a midpoint potential between a power supply and GND, the high-side driver and the low-side driver are conducted at the same time as illustrated in FIG. 16 and a through current flows. To prevent this through current, a (dead time) method is used of generally providing a drive signal of the high-side driver and a drive signal of the low-side driver respectively, and preventing the drivers from being turned on at the same time by slightly shifting switching timings of the drive signals. FIG. 17 is a view illustrating timings of dead times. In FIG. 17, (1) is on-periods of the PCHFET 112, (2) is on-periods of the NCHFET 111 and the other periods are dead times.

In FIG. 18, changes of the voltage, the current and power consumption at each timing in the switching power supply will be described. First, in a state before a period a, the PCHFET 112 is turned on, the current flows from the PCHFET to the capacitor 116 and the PCHFET is consuming power. As to the direction of the current, the direction of arrows in FIG. 15 is positive. In the period a, when the PWM_H becomes high, the PCHFET is turned off, the potential of the PWMO transitions to GND or less due to back electromotive force of inductance characteristics of the coil 115 in FIG. 15. When the potential of the PWMO in this case is lower than a threshold voltage of the NCHFET 111 with respect to the GND, the NCHFET 111 is conducted and the current flows from the GND to the PWMO (coil 115) (period a). During the period a, the current flowing in the NCHFET 111 and the back electromotive force of the coil 115 gradually become lower. Next, when the PWM_L becomes high and the dead time ends, on-resistance of the NCHFET 111 decreases (period b). During the period b, the potential of the PWMO becomes higher than the GND, and the current flowing in the NCHFET 111 becomes a positive value. Next, when the PWM_L becomes low and the NCHFET 111 is turned off, the potential of the PWMO then becomes higher than a power supply VCC due to the back electromotive force of the coil 115. When the potential of the PWMO becomes higher than a threshold voltage of the PCHFET 112 with respect to the power supply VCC, the PCHFET 112 is conducted, and the current flows from the PWMO (coil 115) to the power supply VCC (period c). During the period c, the current flowing in the PCHFET 112 and the back electromotive force of the coil 115 gradually become lower. Next, when the PWM_H becomes low and the dead time ends, on-resistance of the PCHFET 112 decreases (period d). During the period d, the potential of the PWMO becomes lower than the power supply VCC, and the current flowing in the PCHFET 112 becomes a positive value. The above operation is repeated. The change of power consumed in the driver FETs is illustrated in the lowermost part of FIG. 18. When it is assumed that there is no through current, power consumption maximizes in, for example, the period a and the period c in which on-resistance of the drivers becomes great. Generally, it is demanded to shorten these periods as much as possible, prevent the through current and suppress power consumption as a whole.

In order to set dead times of a pair of switching elements of an inverter to appropriate times in which no through current is produced, Japanese Patent Application Laid-open No. 2003-284352 discloses a method of decreasing a dead time TD in which a pair of switching elements of the inverter are commanded to turn off, by ΔTD per predetermined time TS, finding on-resistance of a second switching element based on the current flowing in the second switching element upon switch-on and an applied voltage V* of a motor in process of decreasing the dead time TD, stopping a decrease of the dead time TD when the on-resistance significantly changes rapidly, and setting and fixing the dead time TD to a dead time TD immediately before the on-resistance of the second switching element significantly changes rapidly.

However, conventional integrated circuits require power supplies for four colors in case of a tandem type, and therefore, if driver FETs for four colors are built in, the amount of heat generation due to on-resistance of the driver FETs is likely to exceed the amount of allowable heat of a package of the integrated circuit, and some heat dissipation measure is generally adopted. For example, although a ceramic package of high heat dissipation characteristics is used or a heat dissipation fin is mounted, there is a problem that cost increases in both cases.

Further, the conventional technique disclosed in Japanese Patent Application Laid-open No. 2003-284352 does not solve the problem that the amount of heat generation due to on-resistance of driver FETs exceeds the amount of allowable heat of the package of the integrated circuit.

Therefore, there is a need for a switching power supply device that reduces the amount of heat generation of the integrated circuit that includes the drivers FETs.

SUMMARY OF THE INVENTION

It is an object of the present invention to at least partially solve the problems in the conventional technology.

According to an embodiment, there is provided a switching power supply device that includes: a switching power supply integrated circuit that includes a dead time generating unit that generates a high-side drive signal and a low-side drive signal having a dead time based on a pulse width modulation signal, a drive signal generating unit that generates a first PWM signal and a second PWM signal based on the high-side drive signal, the low-side drive signal, and a voltage of an output terminal of the switching power supply integrated circuit, and a driver that includes a high-side switch element driven by the first PWM signal and a low-side switch element driven by the second PWM signal, the high-side switch element having a drain connected to the output terminal and a source connected to a power supply, the low-side switch element having a drain connected to the drain of the high-side switch element and a source connected to ground; a filter that is connected to the output terminal and includes a coil for cutting off a high frequency and a capacitor for passing the high frequency; a first diode that has a cathode connected to the source of the high-side switch element and an anode connected to the output terminal, the first diode being arranged outside the switching power supply integrated circuit; and a second diode that has a cathode connected to the source of the low-side switch element and an anode connected to the output terminal, the second diode being arranged outside the switching power supply integrated circuit. One of the first diode and the second diode conducts in a period in which both of the high-side switching element and the low-side switching element are turned off. The drive signal generating unit generates the first PWM signal for turning on the high-side switching element when the second diode is turned off, and the drive signal generating unit generates the second PWM signal for turning on the low-side switching element when the first diode is turned off.

According to another embodiment, there is provided an AC power supply device that includes: the switching power supply device according to the above embodiment; and a transformer that boosts an output voltage of the switching power supply device. An AC voltage of a controlled voltage is generated in a manner that a sine wave voltage is received as the set voltage, an output voltage of the switching power supply integrated circuit is applied to the transformer, and an output of the transformer or a proportional voltage of the output of the transformer is compared with the set voltage.

According to still another embodiment, there is provided an image forming apparatus for electrophotography that includes the AC power supply device according to the above embodiment. The AC power supply device is used as a charging power supply to uniformly charge an image carrier with electrical charges.

According to still another embodiment, there is provided an image forming apparatus that includes a plurality of image carriers; a charging power supply that includes a plurality of AC power supply devices each according to the above embodiment, the AC power supply devices being used for the image carriers, respectively. The switching power supply integrated circuit is formed as one integrated circuit including a plurality of output terminals.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, the present invention will be described in detail using embodiments illustrated in drawings. Meanwhile, components, types, combinations, shapes and a relative arrangement described in these embodiments by no means limit the present invention unless specifically described, and are only examples.

As will be described first, features of the present invention lie in making a device of actively increasing a period for flowing a current to external diodes because it is possible to suppress power consumed in a built-in transistor by flowing a current to external diodes in a period in which a large current immediately after switching flows.

Figure 1:
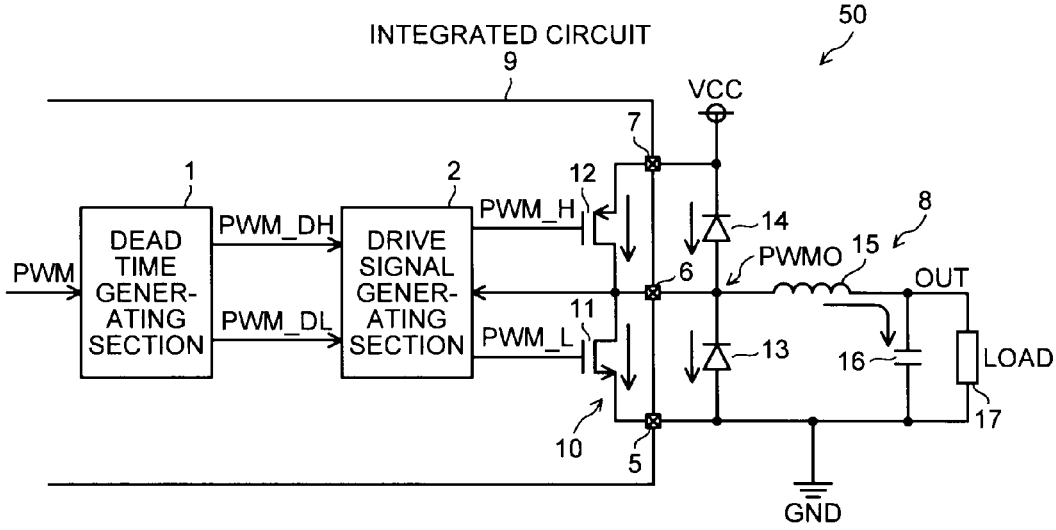
FIG. 1 is a configuration diagram of a driver section, a filter and a diode of a switching power supply according to a first embodiment of the present invention.

FIG. 1 is a configuration diagram of a driver section, a filter and a diode of a switching power supply according to a first embodiment of the present invention.

A switching power supply 50 according to the present invention includes a switching power supply integrated circuit (hereinafter, simply referred to as "integrated circuit") 9. The integrated circuit 9 includes a dead time generating section 1 which generates a PWM_DH (high-side drive signal) and a PWM_DL (low-side drive signal) having dead times, based on a PWM (pulse width modulation signal); a drive signal generating section 2 which outputs a PWM_H (first PWM signal) and a PWM_L (second PWM signal) by monitoring the PWM_DH, the PWM_DL and the PWMO (the voltage of the output terminal); and a driver 10 which is formed with a high-side switching element 12 driven by the PWM_H and a low-side switching element 11 driven by the PWM_L in which a source of the high-side switching element 12 is connected to a power supply terminal 7, a drain of the high-side switching element 12 is connected to a drain of the low-side switching element 11 and an output terminal 6, and a source of the low-side switching element 11 is connected to a ground terminal 5. The switching power supply 50 also includes a filter 8 which is connected to the output terminal 6 and which is formed with a coil 15 which cuts off a high frequency and a capacitor 16 which passes the high frequency. The switching power supply 50 further includes a first diode 14 and a second diode 13 which are arranged outside the switching power supply integrated circuit 9. A cathode of the first diode 14 is connected to the power supply terminal 7 of the high-side switching element 12 and an anode side of the first diode 14 is connected to the output terminal 6. An anode of the second diode 13 is connected to the ground terminal 5 of the low-side switching element 11 and a cathode of the second diode 13 is connected to the output terminal 6. One of the first diode 14 and the second diode 13 is conducted in a period in which both of the high-side switching element 12 and the low-side switching element 11 are turned off, and the drive signal generating section 2 generates a PWM_H for conducting the high-side switching element 12 at a point of time when the second diode 13 is turned off and generates a PWM_L for conducting the low-side switching element 11 at a point of time when the first diode 14 is turned off.

Figure 2:
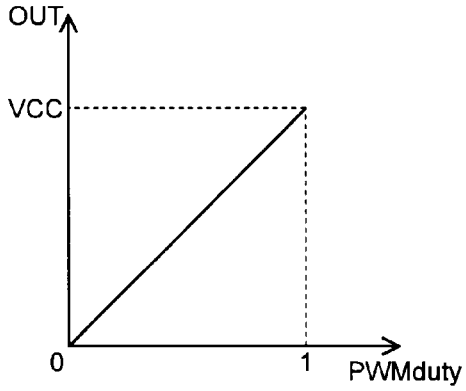
FIG. 2 illustrates voltage characteristics of an output OUT for a PWM signal.

That is, in FIG. 1, a PCHFET 12 and an NCHFET 11, corresponding respectively to the high-side switching element 12 and the low-side switching element 11, which are driver FETs are built inside the integrated circuit 9. A signal for controlling the PCHFET 12 to turn on and off is a PWM_H and a signal for controlling the NCHFET 11 to turn on and off is a PWM_L, and both signals are pulse width modulation signals. The PWMO is the output terminal 6 of the integrated circuit 9, and is connected to the coil 15 of the filter 8. The coil 15 and the capacitor 16 of the filter 8 are arranged on the power supply board. The diode 13 and the diode 14 are arranged outside the integrated circuit 9, and are used to flow a freewheeling current in a period in which both of the PCHFET 12 and the NCHFET 11 are turned off. The dead time generating section 1 receives a PWM signal, and generates the PWM_DH and the PWM_DL having dead times. Further, the drive signal generating section 2 receives the PWM_DH, the PWM_DL and the PWMO, and generates the PWM_H and the PWM_L. FIG. 2 illustrates voltage characteristics of an output OUT for a common PWM signal. An output voltage becomes high in proportion to the duty ratio (high period/(high period+low period)) of the PWM signal. Generally, part of the output voltage is fed back and is compared with a setting value to control the output voltage.

Figure 3:
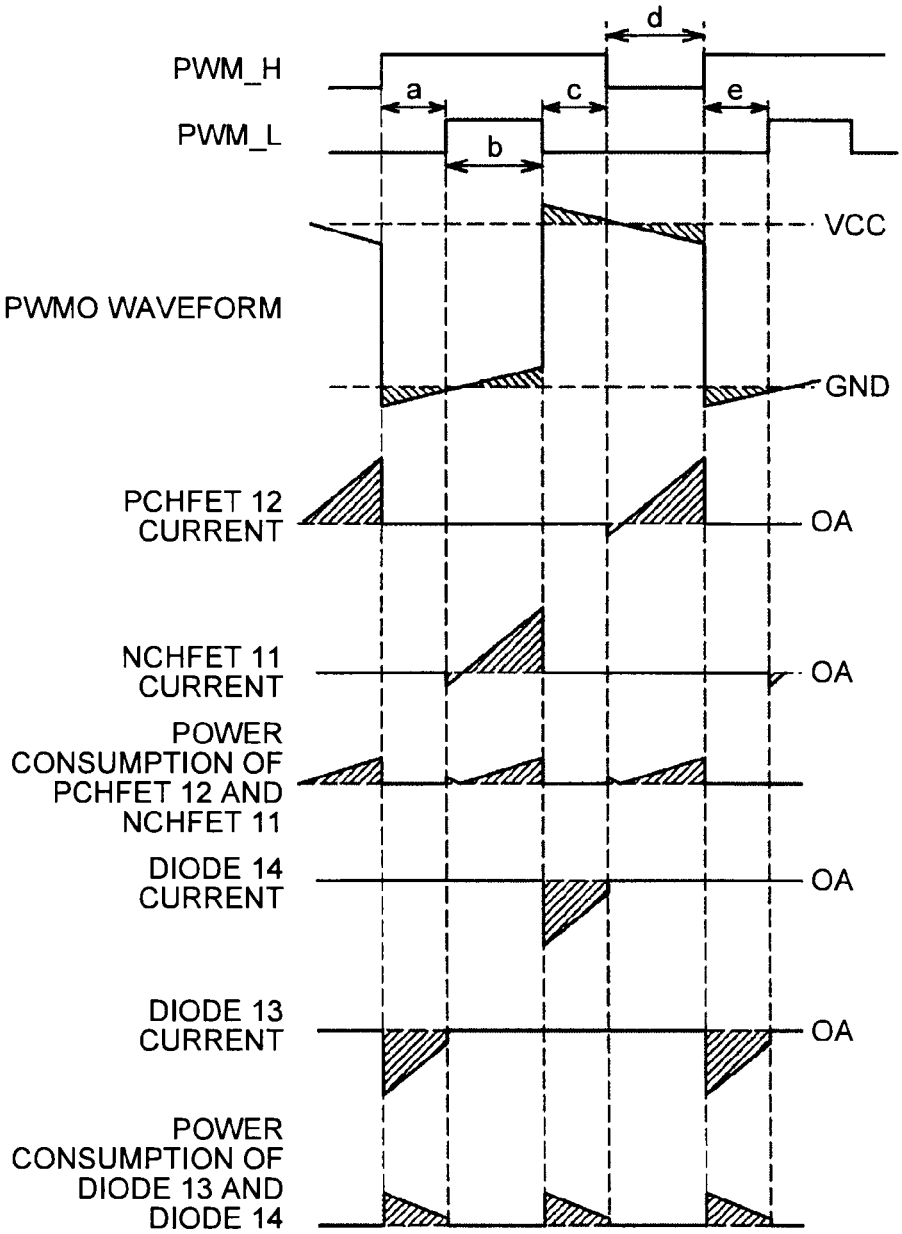
FIG. 3 is a view describing an operation of the switching power supply according to the present invention.

FIG. 3 is a view describing an operation of the switching power supply according to the present invention. FIG. 3 illustrates changes of the voltage, the current and power consumption at each timing. First, in a state before a period a, the PCHFET 12 is turned on, the current flows from the PCHFET to the capacitor 16 and the PCHFET is consuming power. As to the direction of the current, the direction of arrows in FIG. 1 is positive. In the period a, when the PWM_H becomes high, the PCHFET 12 is turned off, the potential of the PWMO transitions to the GND or less due to back electromotive force of inductance characteristics of the coil 15 in FIG. 1. When the potential of the PWMO in this case is lower than an on-voltage of the diode 13 with respect to the GND (the voltage equal to or more than the on-voltage to both ends of the diode 13 in the position direction), the diode 13 is conducted and the current flows from the GND to the PWMO (coil 15) through the diode 13 (period a).

Meanwhile, the threshold voltage of the NCHFET 11 is assumed to be higher than the on-voltage of the diode 13. During the period a, the current flowing in the diode 13 and the back electromotive force of the coil 15 gradually become lower. Meanwhile, by monitoring an output voltage PWMO in the drive signal generating section 2 and controlling the PWM_L to be high at a point of time when the voltage to be applied to both ends of the diode 13 becomes lower than the on-voltage of the diode 13, the NCHFET 11 is turned on and conducted (period b). During the period b, the potential of the PWMO becomes higher than the GND, and the current flowing in the NCHFET 11 becomes a positive value. Next, when the PWM_L becomes low and the NCHFET 11 is turned off, the potential of the PWMO then becomes higher than a power supply VCC due to the back electromotive force of the coil 15. When the potential of the PWMO becomes higher than an on-voltage of the diode 14 with respect to the power supply VCC, the diode 14 is conducted, and the current flows from the PWMO (coil 15) to the power supply VCC through the diode 14 (period c). Meanwhile, the threshold voltage of the PCHFET 12 is assumed to be higher than the on-voltage of the diode 14. During the period c, the current flowing in the PCHFET 12 and the back electromotive force of the coil 15 gradually become lower. Meanwhile, by monitoring the output voltage PWMO in the drive signal generating section 2 and controlling the PWM_H to be low at a point of time when the voltage to be applied to both ends of the diode 14 becomes lower than the on-voltage of the diode 14, the PCHFET 12 is turned on and conducted (period d). During the period d, the potential of the PWMO becomes lower than the power supply VCC, and the current flowing in the PCHFET 12 becomes a positive value. The above operation is repeated.

Figure 18:
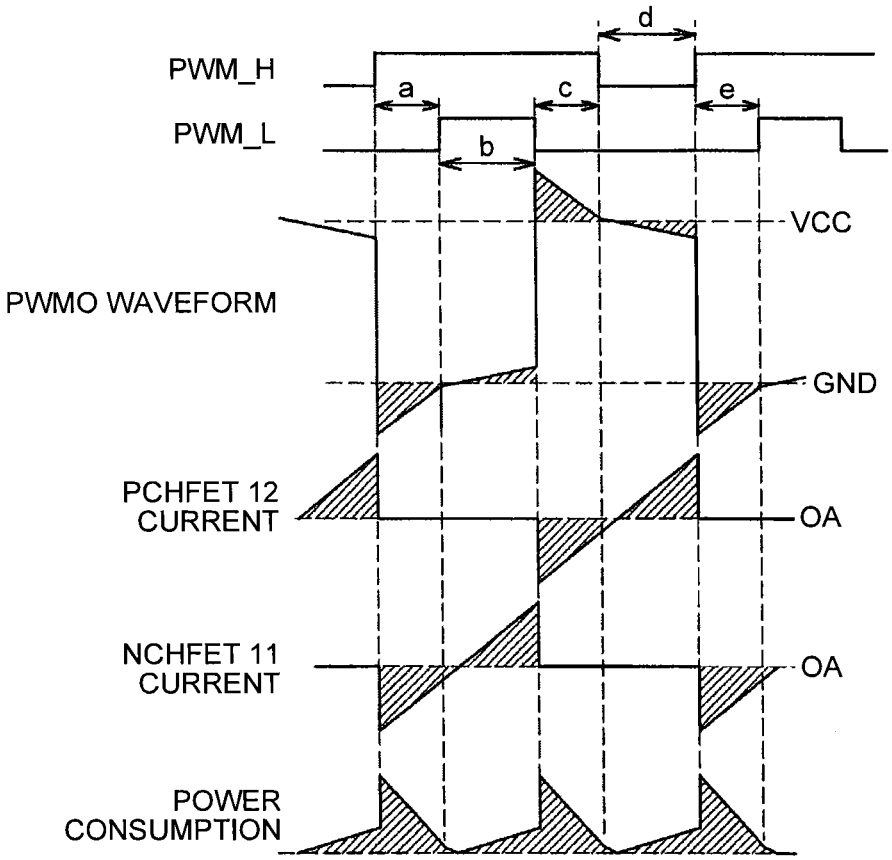
FIG.18 CONVENTIONAL ART
FIG. 18 is a view describing an operation of the conventional switching power supply.

Referring to FIG. 18 to compare the change of power consumed in the driver FETs with that of FIG. 18, power is consumed in the external diode 13 and the diode 14 during the period a, the period c and the period e, and therefore power consumed inside the integrated circuit becomes low. Particularly, for the diode 13 and the diode 14, schottky diodes having a fast operation speed, a low on-voltage and a little on-resistance are preferably used. Further, as is clear from FIG. 3, a longer period such as the period a, the period c and the period e in which both of the PCHFET 12 and the NCHFET 11 are turned off (in a period in which the diode 13 and the diode 14 are conducted) is advantage because power consumption in the integrated circuit becomes little. In this sense, a smaller on-voltage of diodes is more advantageous. In this way, by monitoring the output voltage PWMO at all times and conducting an internal FET at a timing when a freewheeling current cannot flow in the external diode, it is possible to prevent the current from flowing inside the integrated circuit as much as possible, and suppress heat generation of the integrated circuit.

Figure 4:
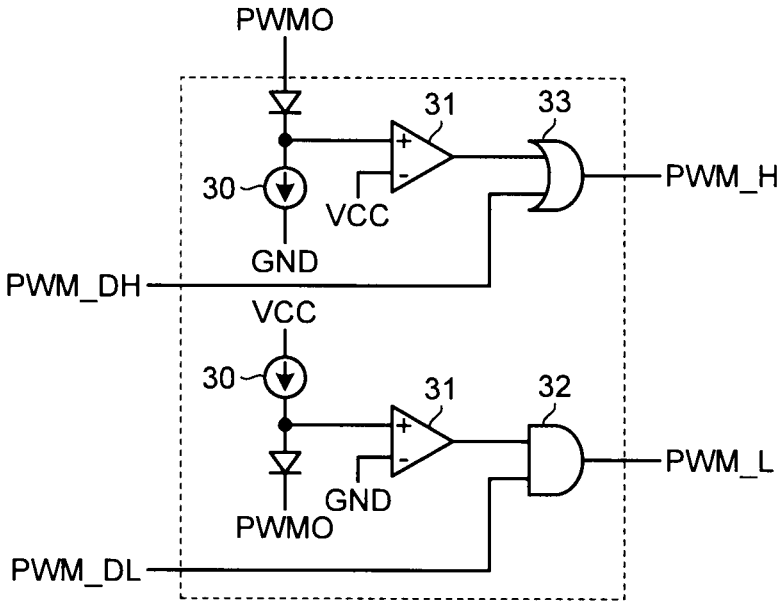
FIG. 4 is a view illustrating a configuration example of a drive signal generating section according to the present invention.
Figure 5:
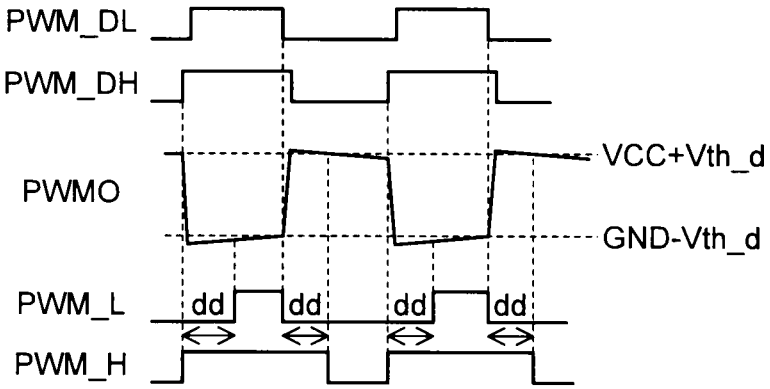
FIG. 5 is a view illustrating an operation timing of the drive signal generating section according to the present invention.

FIG. 4 is a view illustrating a configuration example of the drive signal generating section 2. In FIG. 4, the drive signal generating section 2 is formed with a current supply 30, a diode comparator 31, an AND circuit 32 and an OR circuit 33. Meanwhile, the diodes are simulated as the external diodes, and the same on-voltage is assumed. FIG. 5 illustrates an operation timing in FIG. 4. Meanwhile, Vth_d is an on-voltage of the diode. That is, at a timing when the PWMO is lower than VCC+Vthd, the OR circuit 33 in FIG. 4 is conducted and the PWM_H becomes low. Further, when the PWMO is higher than GND−Vthd, the AND circuit 32 is conducted and the PWM_L becomes high. That is, by monitoring the PWMO and comparing the PWMO with the reference voltage, the PWM_L and the PWM_H which are final stage FET control signals are controlled. When these PWM_L and PWM_H are inputted to a final stage FET, the final stage FET is turned on at a timing when the external diode is turned off.

Figure 6:
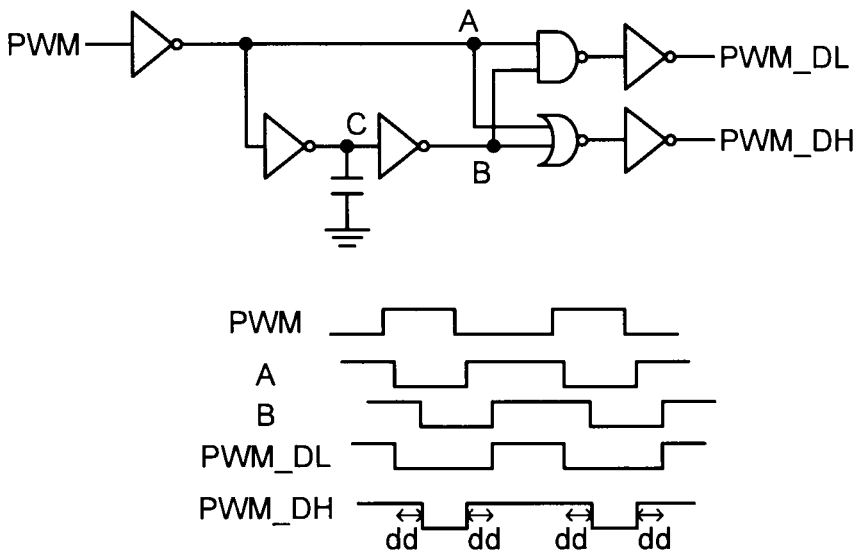
FIG. 6 is a view illustrating a configuration example and an operation timing of a dead time generating section.

FIG. 6 is a view illustrating a configuration example and an operation timing of the dead time generating section 1. The dead time generating section 1 generates the PWM_DL and the PWM_DH from the PWM. By daringly adding a capacitor to a node C, a node change of B is delayed compared to A to generate this period as a dead time. The PWM_DH has a longer high period than the PWM_DL. This dead time generating section 1 generates common dead times for preventing a through current, and, the generated signals (PWM_DL and PWM_DH) are received as input in the drive signal generating section 2 and the PWMO is monitored to obtain control signals PWM_L and PWM_H of more optimized dead times. In addition, although the timing charts in FIGS. 5 and 6 illustrate ideal operations, the operation of the switching power supply is not influenced even when a timing is shifted more or less due to fluctuation.

Figure 7:
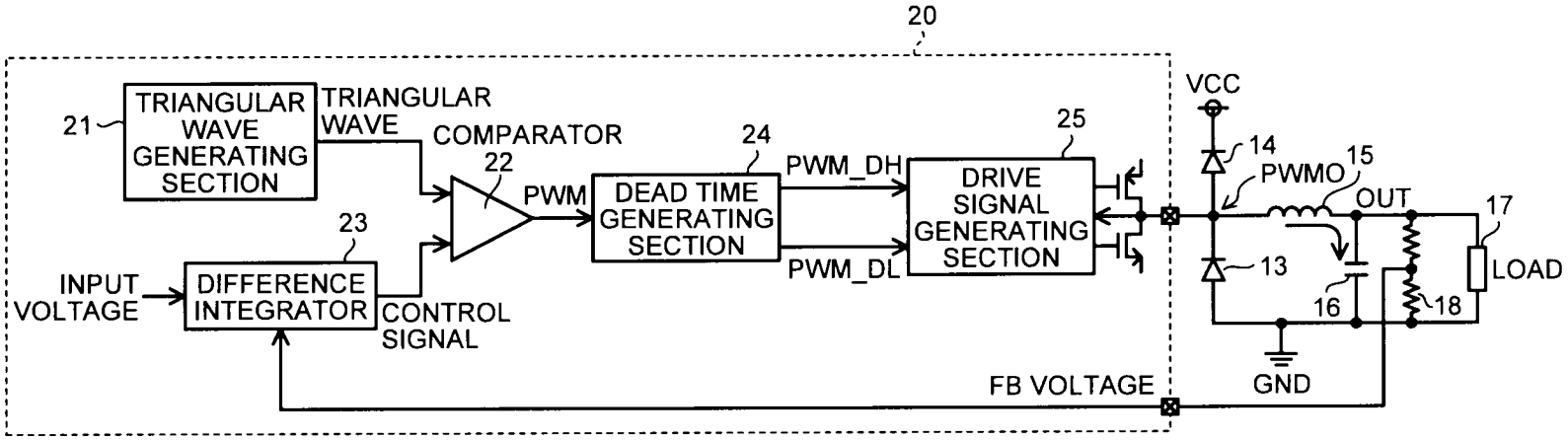
FIG. 7 is a view illustrating a configuration of the switching power supply using the configuration in FIG. 1.

FIG. 7 is a view illustrating a configuration of the switching power supply using the configuration in FIG. 1. In FIG. 7, an integrated circuit 20 is formed with a triangular wave generating section 21, a comparator 22, a difference integrator 23, a dead time generating section 24 and a drive signal generating section 25. Further, outside the integrated circuit, the diode 13, the diode 14, the coil 15, the capacitor 16, a feedback divided voltage resistor 18 and a load 17 are provided. The difference between the input voltage and the FB voltage is integrated by the difference integrator 23, and is outputted as a control signal. The control signal is compared by the comparator 22 with the triangular wave generated in the triangular wave generating section 21, and is converted into a PWM. The PWM is inputted in the dead time generating section 24 to generate a high-side drive signal PWM_DH and a low-side drive signal PWM_DL. The PWM_DH and PWM_DL are inputted to the drive signal generating section 25, are outputted as PWMO, and are smoothed by the filter formed with the coil 15 and the capacitor 16 to generate an output OUT. The control system is configured as a whole by feeding back a divided voltage of the output OUT as a FB voltage, and an output voltage matching the input voltage is generated. Meanwhile, the drive signal generating section 25 is realized by the configuration in FIG. 4, and the dead time generating section 24 is realized by the configuration in FIG. 6. In FIG. 7, although the FB voltage is the divided voltage of the output OUT, the output OUT may be used as is as the FB voltage.

Figure 8:
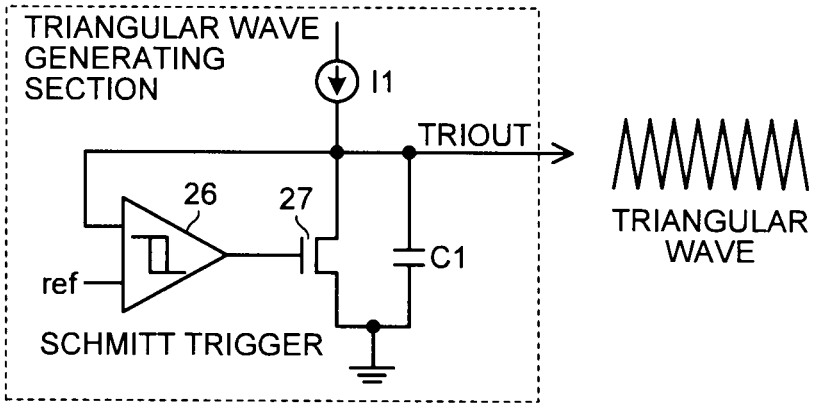
FIG. 8 is a view illustrating a configuration of a triangular wave generating section according to the present invention.

FIG. 8 is a view illustrating a configuration of the triangular wave generating section 21. In FIG. 8, the triangular wave generating section 21 is formed with a current source I1, a schmitt trigger circuit 26, a transistor 27 and a capacitor C1. The schmitt trigger circuit 26 changes a threshold voltage depending on a transition direction of an input voltage, and uses, for example, ref±Vth for the threshold. When, for example, TRIOUT exceeds ref+Vth, the output of the schmitt trigger circuit is inverted, and the transistor 27 is turned on. Electrical charges accumulated in C1 by the transistor 27 are discharged to reduce TRIOUT. Meanwhile, when the potential of TRIOUT is lower than ref−Vth this time, the output of the schmitt trigger circuit 26 is inverted and the transistor 27 is turned off. While the transistor 27 is turned off, the current source I1 electrifies the capacitor C1. Thus, a saw-shaped triangular wave is generated in TRIOUT.

Figure 9:
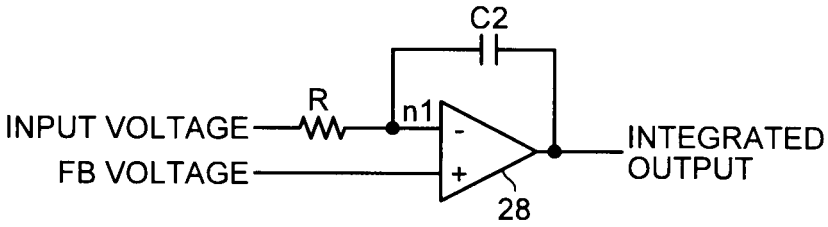
FIG. 9 is a view illustrating a configuration of a difference integrator according to the present invention.

FIG. 9 is a view illustrating a configuration of the difference integrator 23. In FIG. 9, an operational amplifier 28 is configured to provide a feedback, and a node n1 has a FB voltage by way of virtual short-circuiting. A current obtained by dividing a difference voltage between the input voltage and the FB voltage, by a resistance R is accumulated in a capacitor C2 to generate an integrated output.

Figure 10:
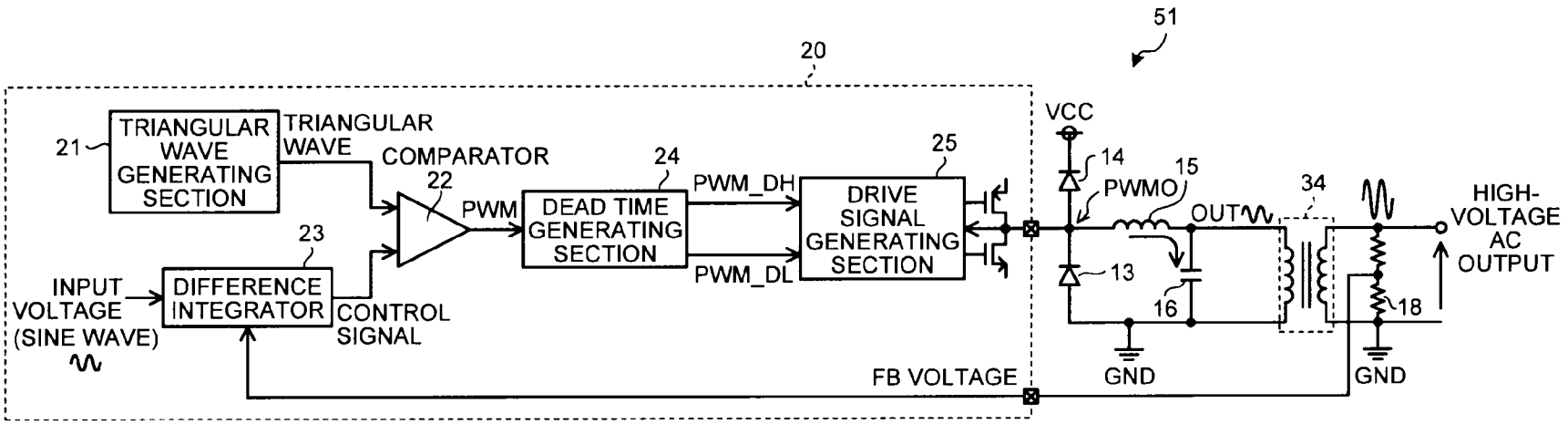
FIG. 10 is a view illustrating a configuration example of a high-voltage AC power supply.
Figure 19:
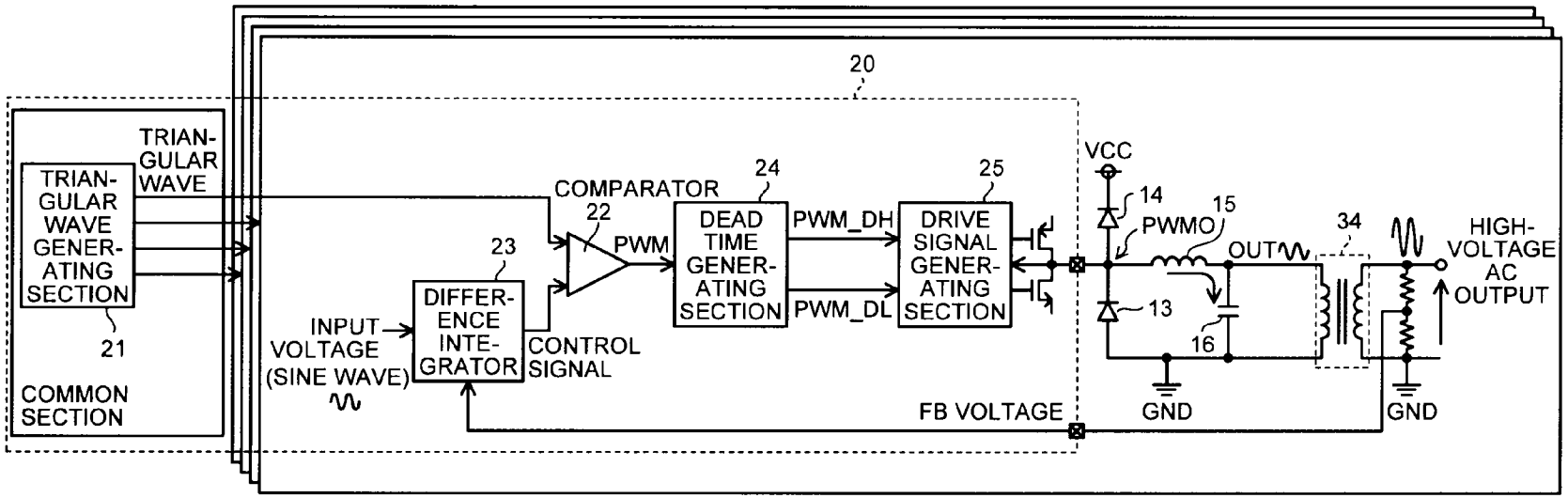
FIG. 19 is a view illustrating a configuration example where a plurality of high-voltage AC power supplies in FIG. 10 are provided.

FIG. 10 is a view illustrating a configuration example of a high-voltage AC power supply. Although the switching power supply in FIG. 7 is basically used, a primary side of a transformer 34 is connected to the output OUT and a high voltage is outputted from the secondary side. Further, a sine wave is inputted as an input voltage. The high-voltage AC output is divided and fed back as a FB voltage. When the turn ratio of the primary side and the secondary side of the transformer 34 is 1:n, it is possible to generate a high-voltage AC output including an n-fold amplitude compared to the amplitude of the input voltage applied to the primary side. Further, FIG. 19 illustrates a configuration example where a plurality of high-voltage AC power supplies in FIG. 10 are provided. In FIG. 19, the triangular wave generating section 21 can be shared, a plurality of integrated circuits need not to be provided and one integrated circuit supports a plurality of outputs, thereby enabling miniaturization.

Figure 11:
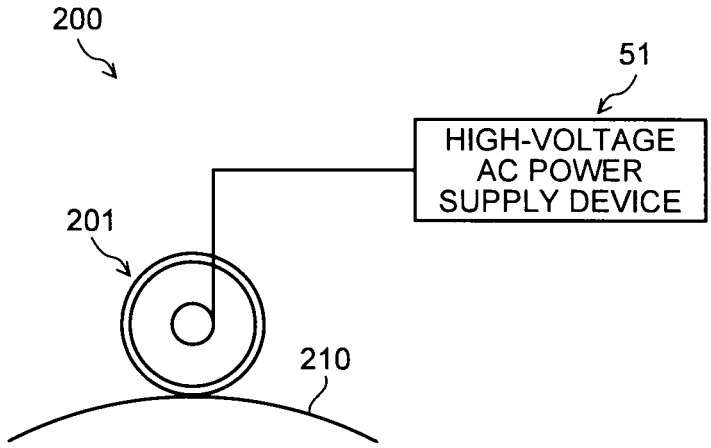
FIG. 11 is a view illustrating an example of a configuration of a charging unit according to the present invention.
Figure 12:
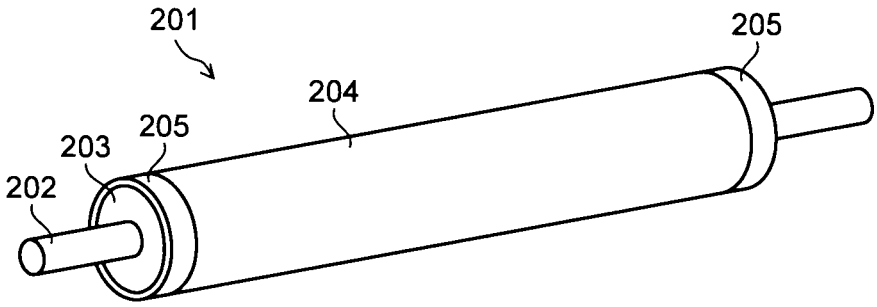
FIG. 12 is a view illustrating a relationship between a high-voltage AC power supply device and a roller charging device of the charging unit.

Further, a high-voltage AC power supply device 51 according to the present invention is preferably applied to a charging unit. FIG. 11 is a view illustrating an example of a configuration of the charging unit according to the present invention. A charging unit 200 includes the high-voltage AC power supply device 51 and a roller charging device 201. In addition, with the present embodiment, although a photosensitive drum 210 is charged by a so-called proximity charging method, the present embodiment is by no means limited to this. As illustrated in, for example, FIG. 12, the roller charging device 201 has a cored bar 202 which has a bar shape, a columnar elastic layer 203 which is provided to wrap the cored bar 202 and which sets resistance to a medium resistance, and a covering layer 204 which covers the outer periphery of the elastic layer 203, improves abrasion resistance and reduces adherence of foreign materials. Further, spacers 205 are provided to prevent portions of the photosensitive drum 210 on which an image is not formed, from being charged. In addition, the spacers 205 may be provided in the photosensitive drum 210 instead of the roller charging device 201. Further, a sheet member such as a belt may be arranged between the roller charging device 201 and the photosensitive drum 210 as a spacer.

By applying the high-voltage AC power supply device 51 to the charging unit 200 in this way, it is possible to save power of the charging unit 200.

Figure 13:
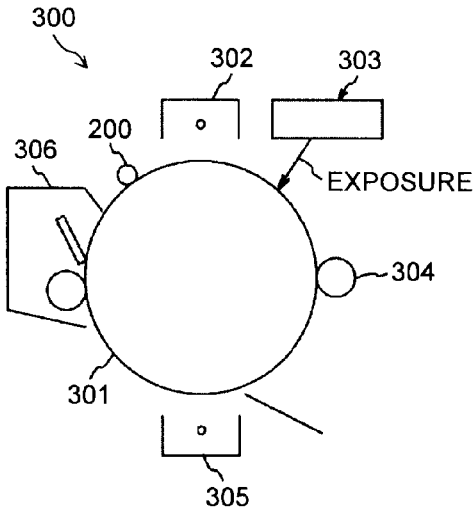
FIG. 13 is a view illustrating a schematic configuration of an image forming section of an image forming apparatus.

Further, the high-voltage power supply device according to the present invention is preferably applied to the image forming apparatus illustrated in FIG. 13. An image forming apparatus 300 has around a photosensitive drum 301, for example, an AC charging unit (charging unit 200) which charges a photosensitive element with a high voltage, a DC charging unit 302, an optical scanning device 303 which exposes image data, a developing unit 304 which adheres toner charged with an electrostatic latent image recorded by the optical scanning device 303 and visualizes an image, a transfer device 305 which transfers the toner adhered to the photosensitive drum 301, to paper and a cleaning device 306 which scratches and accumulates toner left on the photosensitive drum 301. In addition, the configuration and the operation of each section are known, and therefore will not be described. Further, naturally, the image forming apparatus illustrated in FIG. 13 includes the color image forming apparatus.

By applying the charging unit 200 having the high-voltage AC power supply device 51, to the image forming apparatus 300 in this way, it is possible to save power of the image forming apparatus 300.

Figure 14:
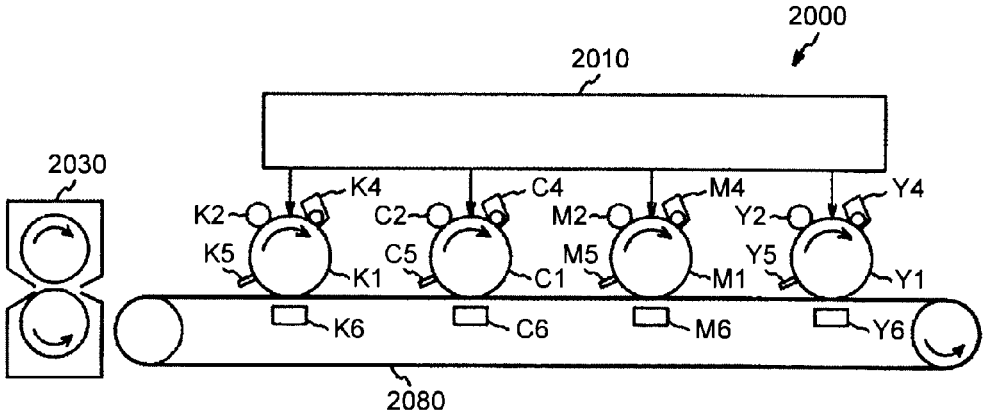
FIG. 14 is a view illustrating a schematic configuration of an image forming section of a tandem-type color image forming apparatus.
Figure 15:
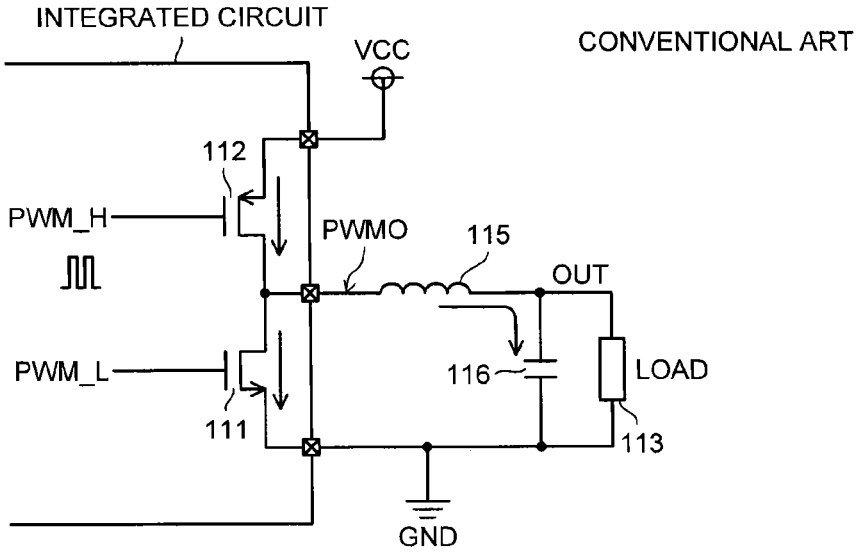
FIG. 15 is a configuration diagram of a driver section, a filter and a diode of a conventional switching power supply.
Figure 16:
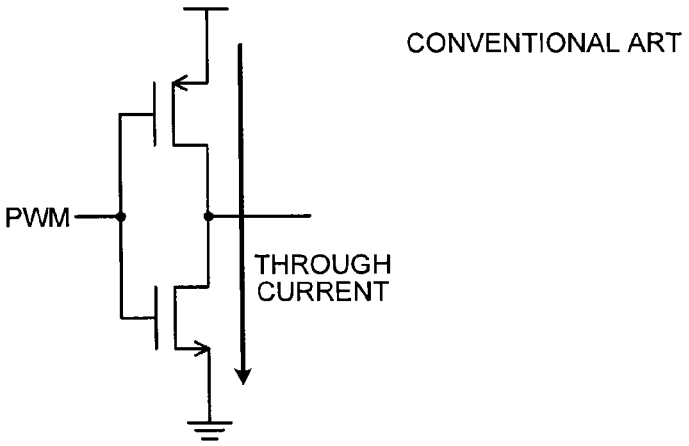
FIG. 16 is a view describing a through current.
Figure 17:
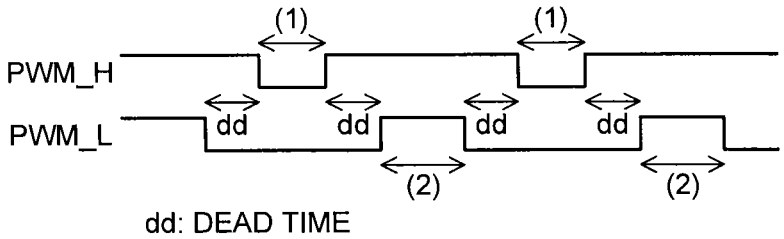
FIG.17 CONVENTIONAL ART
FIG. 17 is a view describing dead timings.

Further, FIG. 14 is a configuration diagram of a color image forming apparatus which includes a plurality of photosensitive drums. This color image forming apparatus 2000 is a multi-color image forming apparatus of a tandem type which forms a full-color image by superimposing four colors (black, cyan, magenta and yellow), and has, for example, "a photosensitive element K1, a charging unit K2, a developing unit K4, a cleaning unit K5 and a transfer unit K6" for black, "a photosensitive element C1, a charging unit C2, a developing unit C4, a cleaning unit C5 and a transfer unit C6" for cyan, "a photosensitive element M1, a charging unit M2, a developing unit M4, a cleaning unit M5 and a transfer unit M6" for magenta, "a photosensitive element Y1, a charging unit Y2, a developing unit Y4, a cleaning unit Y5 and a transfer unit Y6" for yellow, an optical scanning device 2010, a transfer belt 2080 and a fixing unit 2030.

Each photosensitive drum rotates in an arrow direction in FIG. 14, and, around each photosensitive drum, the charging unit, the developing unit, the transfer device and the cleaning unit are respectively arranged in order in the rotation direction. Each charging unit uniformly charges the surface of a corresponding photosensitive drum. The optical scanning device 2010 radiates light on the surface of each photosensitive element charged by this charging unit, and forms a latent image on each photosensitive drum. Further, the corresponding developing unit forms a toner image on the surface of each photosensitive drum. Furthermore, the corresponding transfer device transfers a toner image of each color on recording paper, and the fixing unit 2030 finally fixes an image on the recording paper. By using the charging unit in FIG. 11 for charging units K2, C2, M2 and Y2, using the configuration in FIG. 19 for the high-voltage AC power supply device and integrating the high-voltage AC power supply device for each color in one integrated circuit, it is possible to simplify and miniaturize the configuration of the high-voltage power supply unit.

With the embodiments, power is consumed in the external first diode and second diode, so that it is possible to reduce power consumed inside the power supply integrated circuit. That is, by monitoring the output terminal at all times and conducting internal switching elements at a timing (dead time) when a freewheeling current cannot flow in the external first diode and second diode, it is possible to minimize a flow of the current inside the power supply integrated circuit and suppress heat generation.

The power supply integrated circuit is formed with the triangular wave generating section, the comparator, the difference integrator, the dead time generating section and the drive signal generating section. Further, outside the integrated circuit, the first diode, the second diode, the coil, the capacitor, the feedback divided voltage resistor and the load are provided. The difference between the input voltage and the FB voltage is integrated by the difference integrator, and is outputted as a control signal. The control signal is compared by the comparator with the triangular wave generated in the triangular wave generating section, and is converted into a pulse width modulation signal. The pulse width modulation signal is inputted in the dead time generating section to generate a high-side drive signal and a low-side drive signal. These drive signals are inputted to the drive signal generating section, are outputted as output signals, and are smoothed by a filter formed with the coil and the capacitor to generate an output OUT. The control system is configured as a whole by feeding back a divided voltage of the output OUT as a FB voltage, and an output voltage matching the input voltage is generated.

A multi-output switching power supply device requires drivers for the respective loads. Further, to reduce power consumption of the high-side switching element and the low-side switching element forming the driver, the first diode and the second diode need to be equipped with the output terminal of each driver. By this means, it is possible to suppress power consumption of each driver and suppress heat generation of the integrated circuit.

To generate a high-voltage AC power supply, the output voltage of the switching power supply device is boosted by a transformer. However, the high-voltage AC power supply must not change following fluctuation of the load, and therefore the voltage on the secondary side of the transformer is divided and fed back to the difference integrator. Further, a control voltage is generated by integrating the difference between the voltage and a reference sine wave, and is compared with the triangular wave to generate a pulse width modulation signal. By this means, it is possible to control the change of the voltage following fluctuation of the load, to a given voltage.

An image carrier (photosensitive element) of the image forming apparatus needs to uniformly charge electrical charges to form a latent image. For this charging power supply, the AC power supply device as described above is used. By this means, the charged voltage becomes stable, and stability to form a latent image improves.

The color image forming apparatus has four charging units, and requires a charging power supply for each unit. However, the integrated circuit which controls each charging power supply can be integrated in one package. By this means, it is possible to miniaturize the size of a power supply forming the AC power supply.

According to the embodiments, by arranging diodes outside an integrated circuit and turning off driver FETs inside the integrated circuit while a current flows in the diodes, heat generation in the integrated circuit is reduced. Further, heat generation of the integrated circuit can be optimized by monitoring the output voltage at all times and conducting the driver FETs at a point of time when the output voltage goes below a threshold voltage at which the diodes are turned on, so that it is possible to realize a configuration of reducing the amount of heat generation of the integrated circuit at low cost in the integrated circuit including the driver FETs.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A switching power supply device comprising:

a switching power supply integrated circuit that includes a dead time generating unit that generates a high-side drive signal and a low-side drive signal having a dead time based on a pulse width modulation signal, a drive signal generating unit that includes a current supply, a comparator, an AND circuit, and an OR circuit, and generates a first PWM signal and a second PWM signal based on the high-side drive signal, the low-side drive signal, and a voltage of an output terminal of the switching power supply integrated circuit, and a driver that includes a high-side switch element driven by the first PWM signal and a low-side switch element driven by the second PWM signal, the high-side switch element having a drain connected to the output terminal and a source connected to a power supply, the low-side switch element having a drain connected to the drain of the high-side switch element and a source connected to ground;

a filter that is connected to the output terminal and includes a coil for cutting off a high frequency and a capacitor for passing the high frequency;

a first diode that has a cathode connected to the source of the high-side switch element and an anode connected to the output terminal, the first diode being arranged outside the switching power supply integrated circuit; and a second diode that has an anode connected to the source of the low-side switch element and a cathode connected to the output terminal, the second diode being arranged outside the switching power supply integrated circuit, wherein one of the first diode and the second diode conducts in a period in which both of the high-side switching element and the low-side switching element are turned off, wherein the drive signal generating unit generates the first PWM signal for turning on the high-side switching element when the second diode is turned off, and wherein the drive signal generating unit generates the second PWM signal for turning on the low-side switching element when the first diode is turned off.

2. The switching power supply device according to claim 1, wherein the switching power supply integrated circuit includes a triangular wave generating unit that generates a triangular wave;

a difference integrator that compares a set voltage with an output voltage of the filter or a proportional voltage of the output voltage to generate a resultant difference and generates a control voltage by integrating the difference; and a comparator that generates the pulse width modulation signal by comparing the control voltage with the triangular wave, and wherein the switching power supply integrated circuit controls the output voltage by changing a pulse width of the pulse width modulation signal according to the set voltage.

3. The switching power supply device according to claim 1, further comprising:

a plurality of output terminal each corresponding to the output terminal of the switching power supply integrated circuit;

a plurality of drivers each corresponding to the driver of the switching power supply;

a plurality of first diodes each corresponding to the first diode connected to the corresponding output terminal; and a plurality of second diodes each corresponding to the second diode connected to the corresponding output terminal.

4. An AC power supply device comprising:

the switching power supply device according to claim 1; and a transformer that boosts an output voltage of the switching power supply device, wherein an AC voltage of a controlled voltage is generated in a manner that a sine wave voltage is received as the set voltage, an output voltage of the switching power supply integrated circuit is applied to the transformer, and an output of the transformer or a proportional voltage of the output of the transformer is compared with the set voltage.

5. An image forming apparatus for electrophotography, comprising the AC power supply device according to claim 4, wherein the AC power supply device is used as a charging power supply to uniformly charge an image carrier with electrical charges.

6. An image forming apparatus comprising:

a plurality of image carriers;

a charging power supply that includes a plurality of AC power supply devices each according to claim 4, the AC power supply devices being used for the image carriers, respectively, wherein the switching power supply integrated circuit is formed as one integrated circuit including a plurality of output terminals.

7. The switching power supply device according to claim 1, wherein the voltage of the output terminal of the switching power supply circuit is connected to the comparator.

8. The switching power supply device according to claim 7, wherein an output of the comparator is connected to one of the AND circuit and the OR circuit.

9. The switching power supply device according to claim 1, wherein comparator includes a first comparator and a second comparator, wherein the current supply includes a first current supply and a second current supply, wherein the voltage of the output terminal of the switching power supply circuit and the first current supply are connected to the first comparator, and wherein the voltage of the output terminal of the switching power supply circuit and the second current supply are connected to the second comparator.

10. The switching power supply device according to claim 9, wherein the high-side drive signal and an output of the first comparator are inputs to the OR circuit, and wherein the low-side drive signal and an output of the second comparator are inputs to the AND circuit.

11. The switching power supply device according to claim 10, wherein an output of the OR circuit is the first PWM signal, and wherein an output of the AND circuit is the second PWM signal.

* * * * *